United States Patent [19]

VanderKelen

[11] 4,335,658

[45] Jun. 22, 1982

[54] DOWNHILL SLIDE SYSTEM

[75] Inventor: James B. VanderKelen, Midland, Mich.

[73] Assignee: Snow Machines Incorporated, Midland, Mich.

[21] Appl. No.: 83,401

[22] Filed: Oct. 10, 1979

[51] Int. Cl.[3] ..... A63G 21/04

[52] U.S. Cl. ..... 104/69; 104/124; 104/125; 104/248; 188/41

[58] Field of Search ..... 104/53, 59, 60, 63, 104/64, 69, 118–120, 124–126, 248; 105/141, 144; 188/38, 41

[56] References Cited

U.S. PATENT DOCUMENTS

| | | | |
|---|---|---|---|
| 175,266 | 3/1876 | Banning | 105/141 |
| 860,312 | 7/1907 | Moore | 104/248 |
| 1,064,141 | 6/1913 | Gorham | 105/141 |
| 1,508,319 | 9/1924 | Harris | 104/60 |
| 1,546,620 | 7/1925 | Church | 104/248 X |
| 1,578,893 | 3/1926 | Johnson et al. | 104/69 |
| 1,741,245 | 12/1929 | Maynes | 104/63 |
| 1,838,227 | 12/1931 | Kahl | 104/53 |
| 3,114,332 | 12/1963 | Bacon et al. | 104/63 |
| 3,631,805 | 1/1972 | Schwarzkopf | 104/63 |
| 3,759,186 | 9/1973 | Sugimoto | 104/120 |
| 3,858,517 | 1/1975 | Luck et al. | 104/69 |
| 3,908,556 | 9/1975 | Stühmer | 104/69 X |
| 3,949,680 | 4/1976 | Doughty | 104/124 |
| 3,973,785 | 8/1976 | Becker et al. | 188/8 X |
| 4,221,170 | 9/1980 | Koudelka | 104/69 X |
| 4,236,454 | 12/1980 | Erickson et al. | 104/69 |
| 4,246,846 | 1/1981 | Betschart | 104/69 |

*Primary Examiner*—Randolph A. Reese
*Attorney, Agent, or Firm*—William Miller Yates

[57] ABSTRACT

A recreational mountain slide is basically a double-rail track down which a wheeled cart rolls. The rails are channels of substantially rectangular cross-section laid such that each provides a top, a bottom, and an inside vertical face, each such face being substantially flat, continuous, and unobstructed throughout the length of the track. The rails are mounted on supports which are adjustable and readily removable, being attached to the rails solely along their outer vertical faces. The front wheels of the cart are steerable by the rider. Each wheel is of constant diameter throughout its width and is wider than the rail on which it runs. The wheels are restrained from sliding laterally or jumping vertically off the track by members mounted on the cart in position to bear on the inside vertical face or the bottom face, respectively, of the adjacent rail. The cart also has brakes which can bear upwardly on the bottom face of the rail. The slide is equipped with a timer system actuated by passage of the cart to show the time taken in traversing the slide.

2 Claims, 8 Drawing Figures

Fig. 5
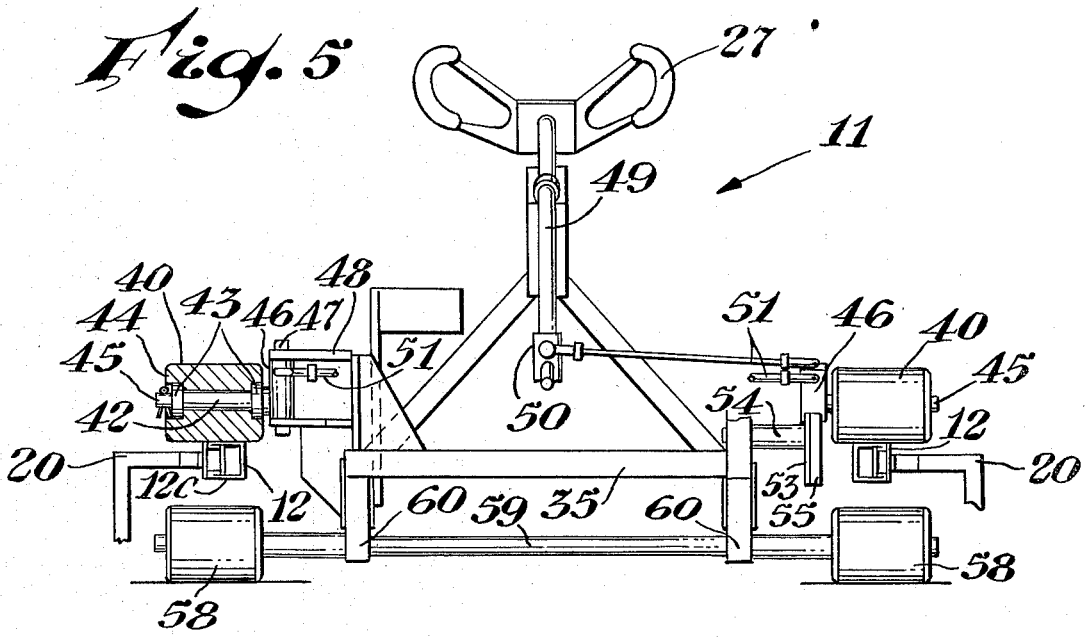
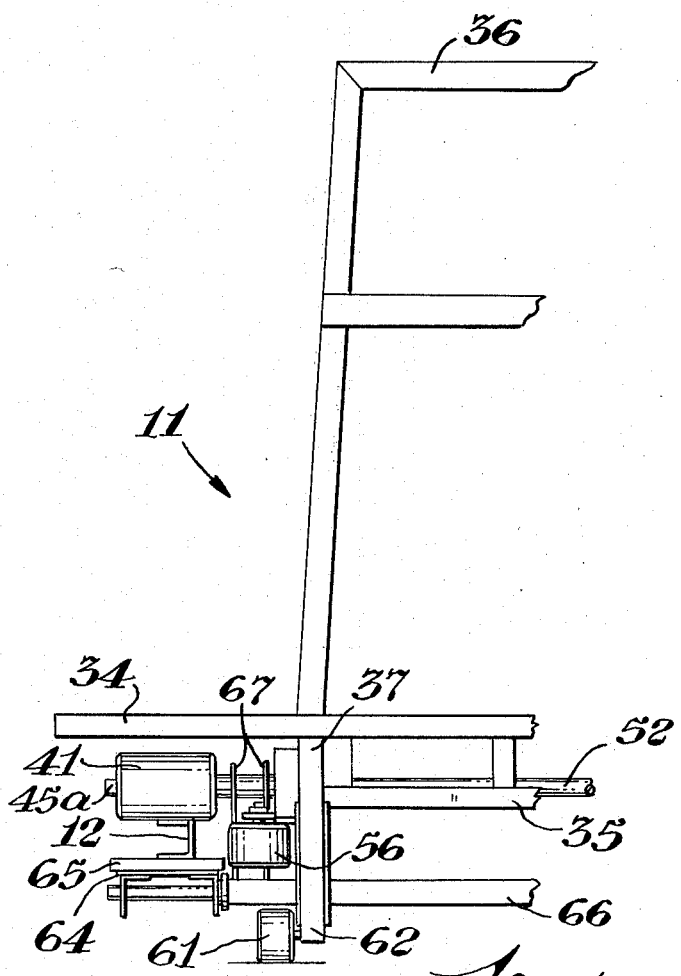
Fig. 6
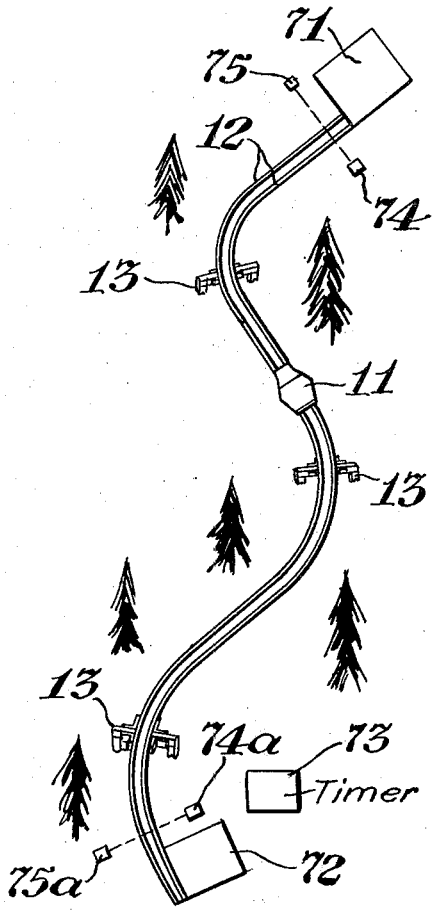
Fig. 7

DOWNHILL SLIDE SYSTEM

FIELD OF THE INVENTION

A recreational mountain slide includes a double-rail track down which a steerable wheeled cart rolls.

BACKGROUND OF THE INVENTION

For many ski resorts, the profitable season is short, being limited to the time when snow is on the slopes. To attract patronage at other times, some resorts have installed additional recreational facilities for use during the off period. Especially popular are mountain slides which provide an all-weather slippery path down which riders glide on mats or sleds.

Typically, as in U.S. Pat. No. 3,970,300, the glide path is a long serpentine dished chute waxed on the inner surface. The rider sits on a special mat provided with a friction brake. For greater thrill and speed, the mat may be replaced by a sled with retractable wheels, as in U.S. Pat. No. 3,973,785. With either, the rider can exert very little control apart from braking. There being no steering mechanism, he can adjust orientation relative to the slide only to a very limited extent, as by shifting his weight. If, in sliding, uneven friction causes the vehicle to drift away from the centerline of the chute and to rub against a side portion, slowing it down, the rider may have difficulty returning it to the speedier center. He can also do little to regulate his lateral position on the slide as he goes through banked turns. Thus, except for minor variations due to differences in their weights and in their braking, successive riders experience nearly identical rides, and there is no real opportunity for competition in speed or skill.

Another type of slide, as in U.S. Pat. No. 3,949,680, is a sled-like roller coaster running on a double-rail track carried on elevated trusswork. In this system also, the wheeled vehicle cannot be steered on the track and there is scant possibility of competitive racing.

Slides of both these types are designed to remain in place year-round. A resort cannot readily install one on a regular ski slope for summer use and remove it for storage as winter approaches. Additional land must be committed permanently to the slide.

SUMMARY OF THE INVENTION

The present invention provides improvements in a mountain slide formed of a double-rail track down which rolls a cart supported on front and rear pairs of wheels. In the invention, one major improvement is that the cart is steerable relative to the track. To achieve this, the wheels of at least one of the pairs are made very wide, so that each such wheel has a rolling surface substantially wider than the rail on which it runs. For steering, the support for each of the wide wheels of one pair is mounted to pivot about a vertical axis to a limited extent, the pivoting being controlled by a steering wheel and linkage operable by the rider of the cart. In contrast to most rail systems, the wheels on the cart of the invention have no flanges but are of essentially constant diameter throughout their width.

In another improvement according to the invention, the rails forming the track are made of channels substantially rectangular in cross-section. These are mounted on supports holding the channels elevated well above the ground. Supports are attached to each channel entirely on its open side, leaving the closed sides or faces of the channel, the top, bottom, and inside vertical faces, substantially flat, continuous and unobstructed throughout the entire length of the track. The cart, the wheels of which rest on the top face of the channel, is thus free to roll smoothly and unimpededly down the entire length of the rails.

To hold the cart on the track laterally, the cart has mounted on it at least one lateral guide member for each supporting wheel in position to bear on the corresponding rail so as to restrain the wheel from sliding outwardly off the rail. The lateral guide members for the steerable wheel pair are spaced apart a distance sufficiently less than the gauge of the track to allow substantial lateral movement in response to steering. It is against the inside vertical face of each rail that each lateral guide member bears. For the steerable wheels, usually the front pair, the lateral guide members are preferably friction pads. For the other supporting wheels, usually the rear pair, the lateral guide members are preferably small wheels.

To keep the cart from jumping vertically off the track, a second or vertical guide member is mounted on the cart for each supporting wheel in position to bear on the bottom face of the corresponding rail to restrain the wheel from lifting substantially above the rail. In the invention, some of these vertical guide members may also function as a braking system, to control the speed of the cart. In this embodiment, the guide members are brake pads mounted on the cart in such position that when actuated they bear upwardly against the bottom face of the corresponding rail.

From the foregoing, it will be seen that in the invention all three of the continuous faces of each rail (channel), i.e. the top, inner vertical, and bottom faces, have an active part in the positioning and control of the cart as it rolls down the track.

As with other downhill rail slides, a rider in the system according to the invention can, if he desires, sit passively in the cart, doing no more than applying the brakes when needed. In this instance, he accepts whatever position the cart takes relative to the track as it rolls down, guided and slowed by the contact of the lateral and vertical guide members with the faces of the rails. However, unlike prior slides, the rider can, if he prefers, take active control and steer the cart down the track, holding to a center position so that there is little or no contact of the lateral guide members with the rail faces. In this way a significantly faster ride can be achieved, depending on the skill of the rider. Meaningful speed contests are possible between different riders.

To assist in judging such contests, the slide system according to the invention may also include an automatic timer having start and stop means actuated by passage of the cart and adapted to indicate the time taken by the cart in traversing the slide.

An additional improvement in the slide system of the invention resides in the ease with which it can be installed on a slope and later removed. By using rails of rectangular channels, the supports holding them in place can be made adjustable and readily removable and re-installable. The system need not be put in place permanently, but can be set up temporarily on a regular ski slope for the duration of the off-season only.

DESCRIPTION OF DRAWINGS

The invention may be further explained with reference to the accompanying drawings, in which

FIG. 5 is a front elevational view of the cart chassis, partly in section, with the upper portion of the frame omitted;

FIG. 6 is a rear elevational view of the left half of the cart chassis; and

FIG. 7 is a schematic panoramic view of the slide system installed on a mountain slope.

DETAILED DESCRIPTION OF THE INVENTION

Figure 1:
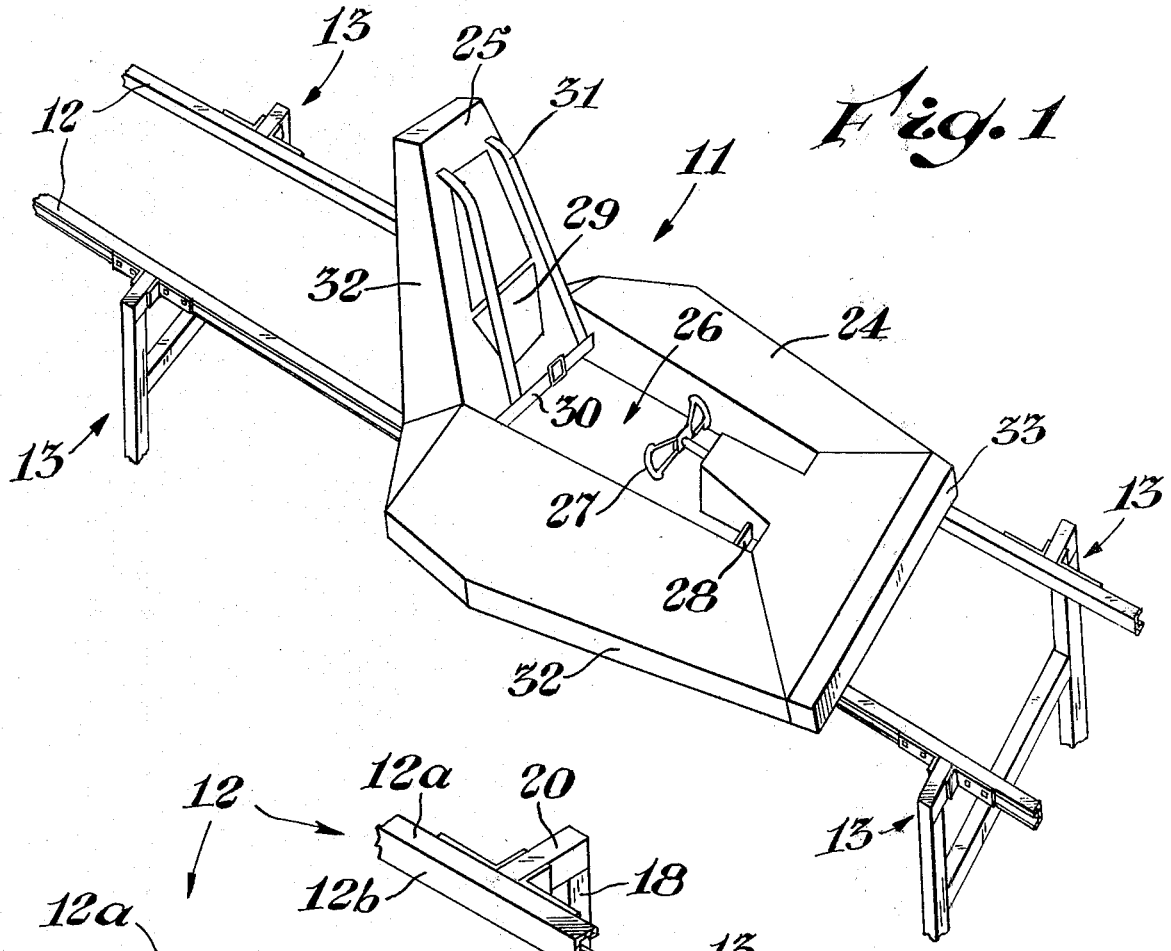
FIG. 1 is a perspective view of a portion of the downhill slide system according to the invention, showing the cart in position as it runs down the double-rail track.

As shown especially in FIGS. 1 and 7, the slide system is a downhill double-rail track on which rolls a wheeled cart, indicated generally as 11.

Figure 2:
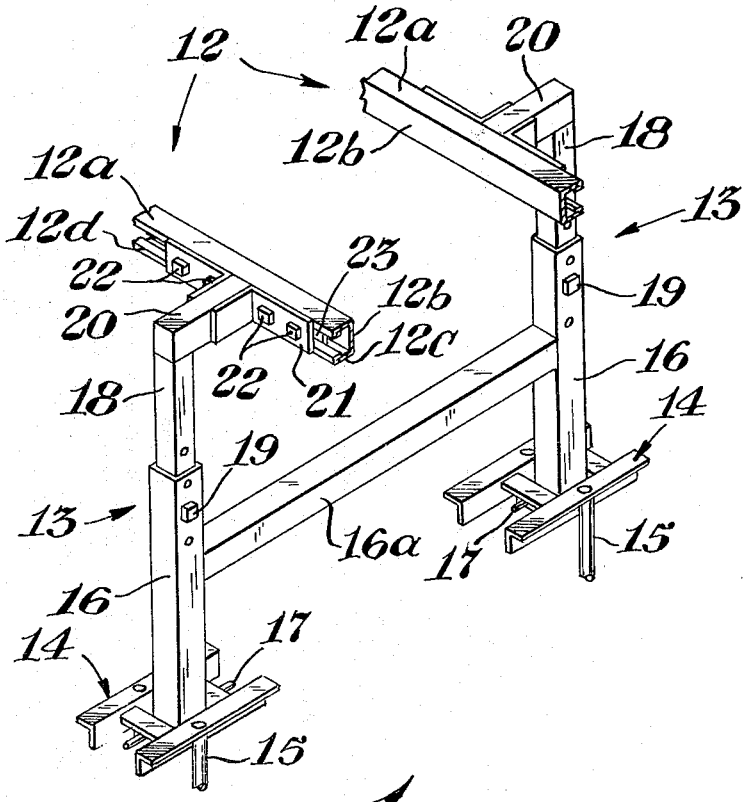
FIG. 2 is a perspective view, partly in section, of the track, showing how it is mounted.
Figure 2A:
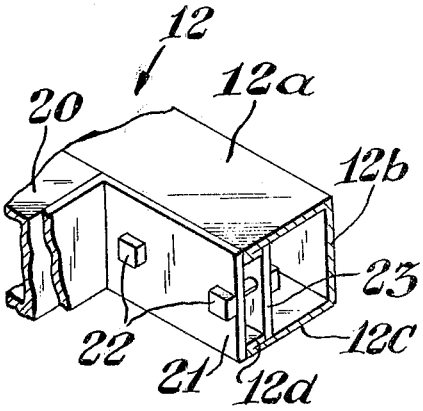
FIG. 2A is an enlargement of a portion of FIG. 2.

In the preferred embodiment shown fragmentarily in FIGS. 2 and 2A, each of the rails 12, 12 forming the track is a length of open channel of substantially rectangular cross-section. Each channel is positioned so that its three closed sides constitute separate faces, i.e. a top 12*a*, an inner vertical 12*b*, and a bottom face 12*c*. Each of the closed sides thus provides a rail surface which is substantially flat, continuous and unobstructed throughout the entire length of the track. The top face 12*a* is the rolling surface on which the cart 11 runs, while the inner vertical and bottom surfaces 12*b* and 12*c* are also in active use for guiding and braking the cart, as will be explained. The fourth or open side of the channel faces outwardly and accommodates the mountings supporting the track. These are sized to hold the rails substantially elevated, i.e. high enough that the cart rolls freely without touching the ground.

As seen in FIG. 2A, on its open side the channel wall is flanged inwardly its full length at top and bottom in sharp reverse bends forming internal strengthening ridges 12*d*. Such channel is available commercially. A preferred size is a 20-foot (6.1 m.) length of rolled 12-gauge (0.27 cm.) strip steel $1\frac{5}{8}$-inch square (4.13 cm. o.d.). The lengths are laid end to end continuously, leaving minimal expansion gaps, thus providing essentially unbroken rail surfaces for the entire slide. Each length of channel may be held rigidly aligned relative to the next by a short splice plate (not shown) extending from within one channel into the next and wedged in place by setscrews. To make a strong slide, channels of the size stated should have support every 60 to 80 inches (1.5 to 2.0 m.) along the track. The distance between the parallel rails, the track gauge, is conveniently 27 inches (0.69 m.).

The rails 12 are held up by support structures indicated generally as 13 which are based on footplates 14. Each plate 14 is a welded assembly of short angle irons made to cleat firmly into the ground. A stake 15 is driven removably into the earth through each footplate to anchor it. Extending vertically upward from each footplate is a post 16 of perforated rectangular tubing, the lower end of which fits into the footplate and is held adjustably to it by a removable bolt 17. Telescoping into the post 16 is a similar but slightly smaller post 18, the exposed length of which may be adjusted by a removable bolt 19. Welded to the top of the post 18 is a horizontal arm 20 of closed rectangular tubing. Integral with this latter are track support brackets 21 which extend horizontally in both directions perpendicular to the arm and parallel to the track channels 12. Through holes in each bracket, bolts 22 extend into the open side of each channel to pass through and engage a lock plate 23 by means of nuts fitted slidably inside the channel. When tightened, the plate 23 bridges and seats on the strengthening ridges 12*d* of the channel, locking it firmly to the support structure 13.

As shown in FIGS. 1 and 2, the corresponding supports 13 for the two rails are placed immediately across from one another in pairs. The supports of each pair are tied together rigidly by a crossbar 16*a* which extends from the post 16 of one track to the corresponding post 16 of the other and is securely bolted or welded at both ends. The length of the crossbar 16*a* controls the spacing between each pair of supports and hence also the gauge of the track. In constructing the slide, the length of each crossbar must be accurately adjusted to insure that the track is of constant gauge throughout. Care must also be taken that the height between each crossbar and the top of the track is sufficient to provide ample clearance for the cart to pass all supports freely.

It will be appreciated that, by adjusting the extent of telescoping of each post 18 relative to its corresponding post 16, the portion of track it supports may be raised or lowered. By making adjustments at each pair of supports the track overall may be held level or at a desired incline despite irregularities in ground surface. Similar adjustments may also allow the track to be banked on curves, or to provide dips and rises in the slide.

The cart 11, which should be as light in weight as feasible, consists of a thin but strong body shell (FIG. 1) molded of plastic which fits over and is fastened to the chassis. The body is conveniently made two-piece, with a generally horizontal main shell 24 and an upright back shell 25. The main shell 24 is shaped to form a cockpit 26 extending down inside the chassis to seat an adult rider on a pad with legs outstretched. Openings admit a steering wheel 27 and brake pedal 28. The back shell 25 is high enough to provide spinal and neck support for the rider and has flattened surfaces 29 to which padding may be attached. Lap 30 and shoulder 31 protective belts extend through the shell to anchor on the chassis. Both shells have skirts 32 extending outwardly and downwardly to shield the rider from accidental contact with the cart mechanism or track. A bumper 33 of resilient foamed plastic is bolted on the front of the cart, and a similar bumper (not shown) is on the back.

Figure 3:
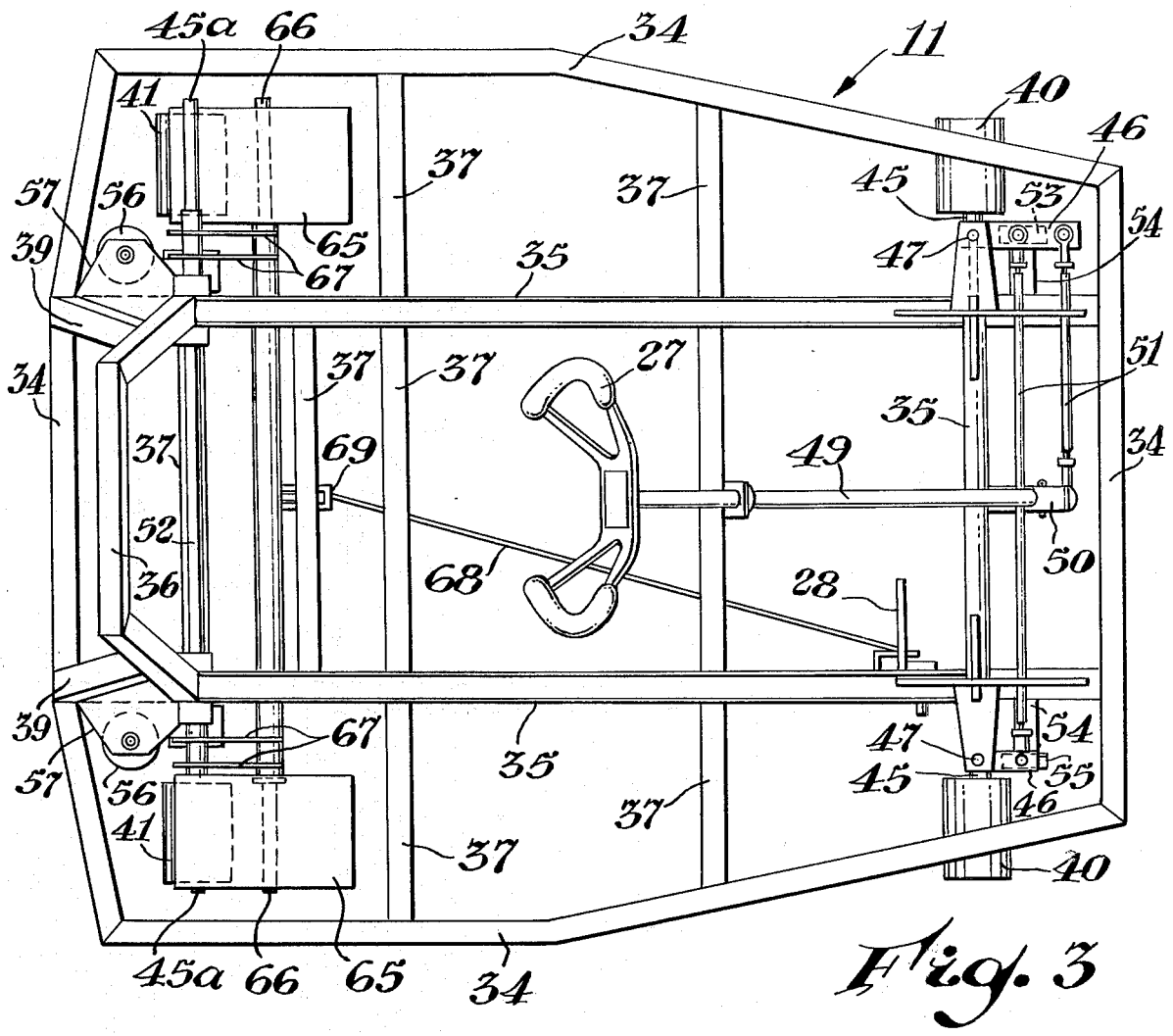
FIG. 3 is a plan view of the chassis of the cart, the body shell having been removed.

The chassis (FIGS. 3 to 6) is made of rectangular aluminum tubing and consists of an upper frame 34 and a lower frame 35 to which the wheels and mechanism are secured, and a backrest frame 36. The upper frame 34 defines the outer perimeter of the chassis, being substantially wider than the gauge of the track toward the rear but tapering down toward the front to approximately gauge width (FIG. 3). The lower frame 35 is narrower than the gauge of the track and at the front is somewhat shorter than the upper frame. The two frames are held spaced apart vertically a distance greater than the diameter of the running wheels by cross-braces 37 extending from the lower to the upper frame along the back, sides and front. The frames and braces are secured rigidly together to make a cage-like structure over which the body shell 24 fits with the cockpit 26 extending downwardly inside the lower frame 35. An additional frame member 38 extends across the front somewhat below the upper frame 34, co-operating with it to form a seat for the bumper 33. The backrest frame 36 is secured to the lower frame 35 and held firmly by braces 39 to support the back shell 25.

Supporting the entire cart are the running wheels front 40 and rear 41, which roll on the channel rails 12. These wheels have no flanges but are horizontal cylinders of constant diameter throughout their length and preferably elongated, so that the width considerably exceeds the diamater. Each wheel is substantially wider than the rail on which it runs, preferably more than two times wider, to allow ample lateral movement of the cart relative to the track during steering. As seen in FIG. 5, each wheel has a tubular steel core 42 with a ball bearing 43 at each end, all surrounded by a solid cylindrical block or tire 44 molded of polyurethane, rubber, or other resilient wear-resistant material. (Acceptable wheels, when big enough, are those sold as "elephant wheels" for large skateboards).

The front wheels are steerable and are supported by a conventional front-end suspension. This latter includes a short wheel spindle 45 on each side integral with a knuckle 46 which pivots on a kingpin 47 fitting through hinge brackets 48 welded to the frame. Each wheel is thus held in a mount adapted to pivot about a vertical axis. The extent of pivoting is controlled by the steering wheel 27 which can turn the steering column 49 journaled in supports attached to the frame. The column terminates in a steering arm 50 which can move the adjustable tie-rods 51 and associated linkage connected to the steering knuckle 46.

The rear wheels are more simply mounted. At each side of the cart the core of a rear wheel is slipped on the spindle end 45*a* of the rear axle 52, which extends continuously across the cart and is held horizontally in the frame. Both front and rear, the lateral spacing between the wheels is such that when the cart is centered on the track each wheel rests on its rail so that the latter is slightly inboard from the center of the wheel (FIG. 5).

To restrain the front wheels 40 from sliding laterally off the track, a guide member (rubbing block) is mounted beside each wheel in position to bear on the vertical inside face 12*b* of the corresponding rail. As in FIG. 5, this block consists of a plate 53 held vertically by an arm 54 fastened to the frame and faced with a flat pad 55 of brake lining or other rub-resistant material. The inner faces 55 of the two rubbing blocks on opposite sides of the cart are spaced apart a distance sufficiently less than the gauge of the track to allow substantial lateral movement of the cart in response to steering. A two to three-and-one-half inch (5 to 9 cm.) clearance or steering play is satisfactory. As will be apparent, to insure that neither wheel 40 can run off the track and fall between the rails, the outside end to end spacing of the two wheels 40 must be substantially greater than the gauge of the track plus the steering play.

The rear wheels are also restrained from sliding off the track by guide members spaced apart the same distance as the front rubbing blocks. However, these rear guides are small wheels 56 generally similar to the running wheels. They are held to the frame, with axles vertical, by mounts 57, one near each wheel 41. One or the other of the wheels 56 can bear on the corresponding inner surface of the rail if the cart veers to one side or the other.

To keep the cart from jumping vertically off the track, a retaining wheel 58 (FIGS. 4 and 5) is mounted below each front wheel 40 in position to bear on the bottom face 12*c* of the corresponding rail. These wheels 58, identical in construction to the running wheels 40, fit on the spindle ends of a lower axle 59 which passes through mounts 60 integral with and extending below the lower frame 35. Vertical spacing is such that when the running wheels 40 are resting on the rails 12, the retaining wheels 58 have good clearance below the rails, preferably one to two inches (2.5 to 5.0 cm.). The wheels 58 also serve an additional purpose of supporting the cart when it is off the rails and resting on the ground, acting as front handling wheels to help roll the cart along.

Figure 4:
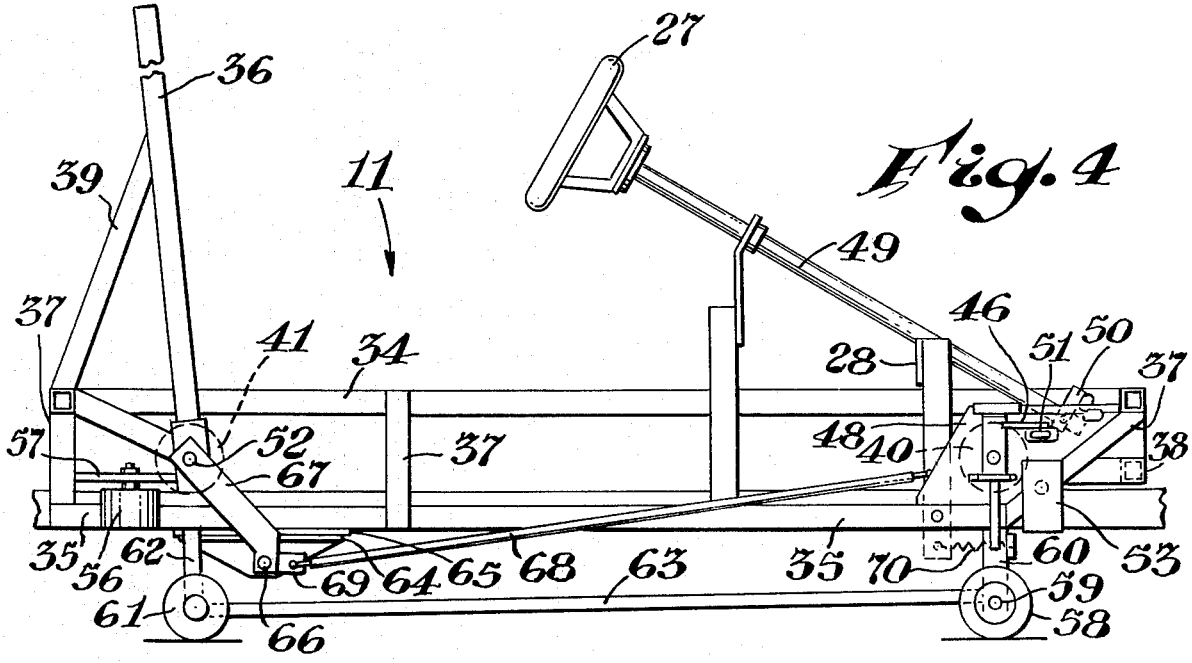
FIG. 4 is a right side elevational view of the chassis, with the near side of the frame cut away.

Similar but narrower ground handling wheels 61 are mounted below the rear wheels 41 (FIGS. 4 and 6). They are held in place by brackets 62 secured to the frame and strengthened by tie bars 63 (FIG. 4) extending from them to the front wheel mounts 60.

As shown in FIGS. 3, 4, and 6, two brakes are provided for slowing or stopping the cart on the track. One is fitted below each rear running wheel 41 in position when actuated to bear upwardly on the bottom face 12*c* of the corresponding rail. Each brake consists of a shoe 64 to the upper flat surface of which is fastened a pad 65 of brake lining or a block of polyurethane grooved crosswise. The two shoes are mounted rockably on opposite ends of a shaft 66 which is supported toward its ends by rocking arms 67 which turn pivotally on the rear axle 52. The brake is actuated by a brake rod 68 which is hinged at the rear by linkage 69 to the center of the brake shaft 66. This arrangement helps to insure that the braking pressure is the same on both pads 65. At the front, the brake rod 68 is linked to the brake pedal 28 which is pivoted on the lower frame. The brakes, shown engaged in FIGS. 4 and 6, are normally held in released position by a pedal spring 70 which extends to one of the mounts 60. As the brakes are released, the rocking arms 67 move downwardly in front to provide substantial clearance between the brake pads 65 and the rails. Advantageously, in released position, each brake shoe is held (by a spring not shown) with its front end tilted down, so that when the brake is applied the heel end of the lining makes contact with the bottom of the rail slightly before the toe.

As will be appreciated, in the embodiment of FIGS. 3 to 5, the brake shoes 64, besides slowing the cart when applied, are at all times in position to restrain any tendency of the rear of the cart to jump vertically off the rails.

Installation and use of the slide according to the invention may now be explained with reference to FIG. 7. As shown schematically, the track formed by the parallel channels 12 courses down a mountain slope from a top starting platform 71 to a bottom landing platform 72. The track may be laid with straight sections, banked curves, dips, or other desired configurations. It is held well above the ground by adjustable supports 13 set firmly but removably in the ground, as detailed in FIG. 2. Since the spacing between successive supports must be short, a considerable number are required for a long slide. (Only a few are shown in FIG. 7.) Because of the relative ease of mounting and removing the track and supports, a ski resort may install the slide temporarily on one of its regular slopes used for skiing during the winter season. At the end of the summer it may be removed for reinstallation another year. Conveniently, the slide platforms 71 and 72 may be placed near the top and bottom of whatever passenger lift (not shown) is permanently in place on the slope.

For the slide, the resort provides an ample number of identical carts 11 constructed according to the invention. As mentioned, each is lightweight and can be easily pushed along the ground on its handling wheels 58 and 61. Only a single attendant is needed at each platform 71 or 72 to handle carts.

In operation, the attendant at the starting platform 71 sets each cart 11 in place on the track with its running wheels 40 and 41 resting on the channel rails 12. A single rider then is seated in the cockpit 26 of the cart with belts 30 and 31 fastened, hands on the steering wheel 27, and foot prepared to push the brake pedal 28. After shove-off, the cart glides down the slide with the rider applying the brakes, if at all, as he prefers, until the bottom platform 72 is reached. If the rider does not steer, the cart will still follow the track, with the front rubbing pads 55 and rear guide wheels 56 bearing on one or the other of the vertical inner faces of the channels to keep the cart from sliding laterally off the rails and also to slow it down frictionally. If one or the other of the running wheels should tend to lift vertically above the track because of some inertial imbalance, a front retaining wheel 58 or a brake pad 65 may rub on the bottom face of a channel to prevent the wheel from moving far enough to jump the track. Usually, however, the rider will try to steer the cart to hold it centered on the track, avoiding frictional contact with either inner vertical face of the rail and achieving greater speed. As the cart approaches the bottom platform 72, the rider applies the brakes to stop the cart and gets out. An attendant then lifts the cart off the track and wheels it over to the passenger lift to be hauled back up the slope.

In an emergency, if a fast stop is desired, the rider may augment the action of the brakes 65 by sharply steering the cart toward one side of the track. This action causes heavy rubbing by the front pads 55 and wedging by the rear guide wheels 56, further slowing the cart. If an obstruction appears on the track and the rider cannot stop the cart, the bumper 33 helps to minimize any effect of impact.

It is also desirable, as an extra precaution in building the slide, to lay the rails so that they go a short distance beyond the lower platform 72 and there converge gradually. If a rider should become disabled and the cart should glide beyond the platform, it will encounter this region of narrower gauge; the rubbing pads 55 and guide wheels 56 will become pinched by the track, stopping the cart.

To give precise indication of the time required for a cart to traverse the slide, and hence also indication of the average speed attained, an automatic indicating or printing timer 73 is placed near the bottom platform 72. This timer is wired or radio-controlled to receive an impulse to begin timing from a photocell relay 74 near the upper platform. This relay is placed so that it generates its trigger impulse when passage of the cart 11 interrupts a beam from a spotlight 75. Near the lower platform 72, passage of the cart triggers a similar relay system 74*a*–75*a* to transmit a stop impulse to the timer 73. Thus, as the rider completes his ride and leaves the platform 72, he can inspect the timer 73 and see figures indicating the duration of his ride and his speed, or even be handed a printed ticket on which these figures appear.

As a sport, riders may seek to improve their speeds on the slide by learning to steer the carts carefully and by braking as little as they dare. Competition between different riders is also possible, each vying to achieve the shortest time down, as shown by the timer 73.

It should be understood that the foregoing detailed description of the invention is intended as representative only of the best mode known to the applicant. Other embodiments and variations will be apparent to those skilled in the art within the scope of the appended claims.

I claim:

1. A mountain slide system comprising:

a double-rail track, each rail being of substantially rectangular cross-section with top, bottom, and inside vertical faces each substantially flat, continuous and unobstructed throughout the length of the track, and being mounted well above the ground on supports attached to it along its outside vertical face; and a cart having front and rear wheel pairs mounted to support it on the track, each wheel being of substantially constant diameter throughout its width, such width considerably exceeding the diameter and being at least twice that of the rail on which it runs, the wheels of the front pair being held in separate mounts each adapted to pivot about a vertical axis to allow steering the cart relative to the track, a guide member for each supporting wheel mounted on the cart in position to bear on the vertical inside face of the corresponding rail to restrain the wheel from sliding laterally outward off the rail, said guide members for each pair of wheels being spaced apart a distance sufficiently less than the gauge of the track to afford substantial steering clearance, the guide members of the front wheels being rubbing blocks and of the rear wheels being smaller wheels with vertical axles, a pair of brakes operable by the rider, each including a pad movably mounted below a rear supporting wheel in position to bear on the bottom face of the corresponding rail when actuated or when the rear of the cart tends to jump vertically off the rail, the cart also having mounted thereon front and rear pairs of ground handling wheels for rolling the cart when off the rails, the front pair of such handling wheels also serving as retaining wheels to restrain the supporting wheels from lifting substantially above the rails, one such front handling wheel being mounted below each front supporting wheel in position to bear on the bottom of the corresponding rail, and steering means operable by the rider of the cart to control the pivoting of the steerable wheels.

2. A mountain slide system comprising:

a double-rail track, each rail being of substantially rectangular cross-section with top, bottom, and inside vertical faces each substantially flat, continuous and unobstructed throughout the length of the track, and being mounted well above the ground on supports attached to it along the outside vertical face; and a cart having front and rear wheel pairs mounted to support it on the track, each wheel being of substantially constant diameter throughout its width, such width considerably exceeding the diameter and being at least twice that of the rail on which it runs, each wheel of the front pair being held in a mount adapted to pivot about a vertical axis to allow steering the cart relative to the track, a guide member for each supporting wheel mounted on the cart in position to bear on the vertical inside face of the corresponding rail to restrain the wheel from sliding laterally outward off the rail, said guide members for each pair of wheels being spaced apart a distance sufficiently less than the gauge of the track to afford substantial steering clearance, the guide members of the front wheels being rubbing blocks, a pair of brakes operable by the rider, each including a pad movably mounted below a rear supporting wheel in position to bear on the bottom face of the corresponding rail when actuated or when the rear of the cart tends to jump vertically off the rail, the cart also having mounted thereon front and rear pairs of ground handling wheels for rolling the cart when off the rails, the front pair of such handling wheels also serving as retaining wheels to restrain the supporting wheels from lifting substantially above the rails, and steering means operable by the rider of the cart to control the pivoting of the steerable wheels.

* * * * *